US005122082A

United States Patent [19]

Lee

[11] Patent Number: 5,122,082

[45] Date of Patent: Jun. 16, 1992

[54] PLUG-IN ELECTRICAL RECEPTACLE

[76] Inventor: James Lee, No. 10, Alley 10, Lane 321, Hsinming Rd., Neihu Dist., Taipei, Taiwan

[21] Appl. No.: 788,246

[22] Filed: Nov. 5, 1991

[51] Int. Cl.[5] ..... H01R 13/00

[52] U.S. Cl. ..... 439/652

[58] Field of Search ..... 439/650-655

[56] References Cited

U.S. PATENT DOCUMENTS 3,005,179 10/1961 Holt ..... 439/652

5,004,435 4/1991 Jammet ..... 439/652

*Primary Examiner*—Joseph H. McGlynn

*Attorney, Agent, or Firm*—Merchant, Gould, Smith, Edell, Welter & Schmidt

[57] ABSTRACT

A multiple electrical receptacle unit adapted to be attached to a wall-mounted receptacle has a housing including a plurality of prong-receiving apertures penetrating the housing and a perimetric edge defining a wall-facing opening; a coupling means including a back plate which is integral with a plurality of pods as well as a plurality of spacers situated between the back plate and the pods, and a plurality of plugs having prongs projecting through the back plate for engagement in a wall receptacle. The coupling means is received within the perimetric edge of the housing to define a space between the plate and the housing, and the pods are within the housing adjacent to the apertures. Each pod encases a plurality of contact strips, and each strip is aligned with at least two of the apertures of the housing and is electrically connected to the prong of the plug.

6 Claims, 3 Drawing Sheets

PLUG-IN ELECTRICAL RECEPTACLE

BACKGROUND OF THE INVENTION

The present invention relates to electrical plug receptacle units and particularly to multiple electrical plug receptacle units adapted to be attached to a wall-mounted receptacle.

As shown in FIG. 1, a conventional electrical plug receptacle adapter unit generally comprises a housing 4 having a plurality of prong-receiving apertures 40 penetrating the housing 4 and a perimetric edge defining a wall-facing opening. A plurality of pods 41 are fixed within the housing 4 adjacent to the plurality of apertures 40, each pod 41 encasing a plurality of contact strips 42, and each strip 42 being aligned with at least two of the apertures 40. Each pod 41 includes a plurality of tabs 45 on an outward facing side thereof. A back plate 3 received within the perimetric edge of the housing 4 to define a space between the back plate 3 and the housing 4. The back plate 3 includes a plurality of prongs 32 projecting through slots 30 of the back plate 3 and a plurality of partitions 31 for dividing the prongs 32. The housing 4 further includes a plurality of linear webs 43 for engaging the tabs 45 of the pods 41 and a plurality of J-shaped webs 44 for receiving the pods 41 at predetermined positions.

To assemble a conventional electrical plug receptacle adapter unit requires a number of procedures, which can be obviated, such as by positioning the pods 41 into the housing 4 and positioning the partitions 31 and prongs 32 into the back plate 3.

It is the purpose of this present invention, therefore, to mitigate and/or obviate the above-mentioned drawbacks in the manner set forth in the detailed description of the preferred embodiment.

SUMMARY OF THE INVENTION

It is an object of the present invention to provide a multiple electrical plug adapter unit comprising a back plate which is integral with a plurality of pods for decreasing the number of procedures in assembling an electrical plug adapter unit.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
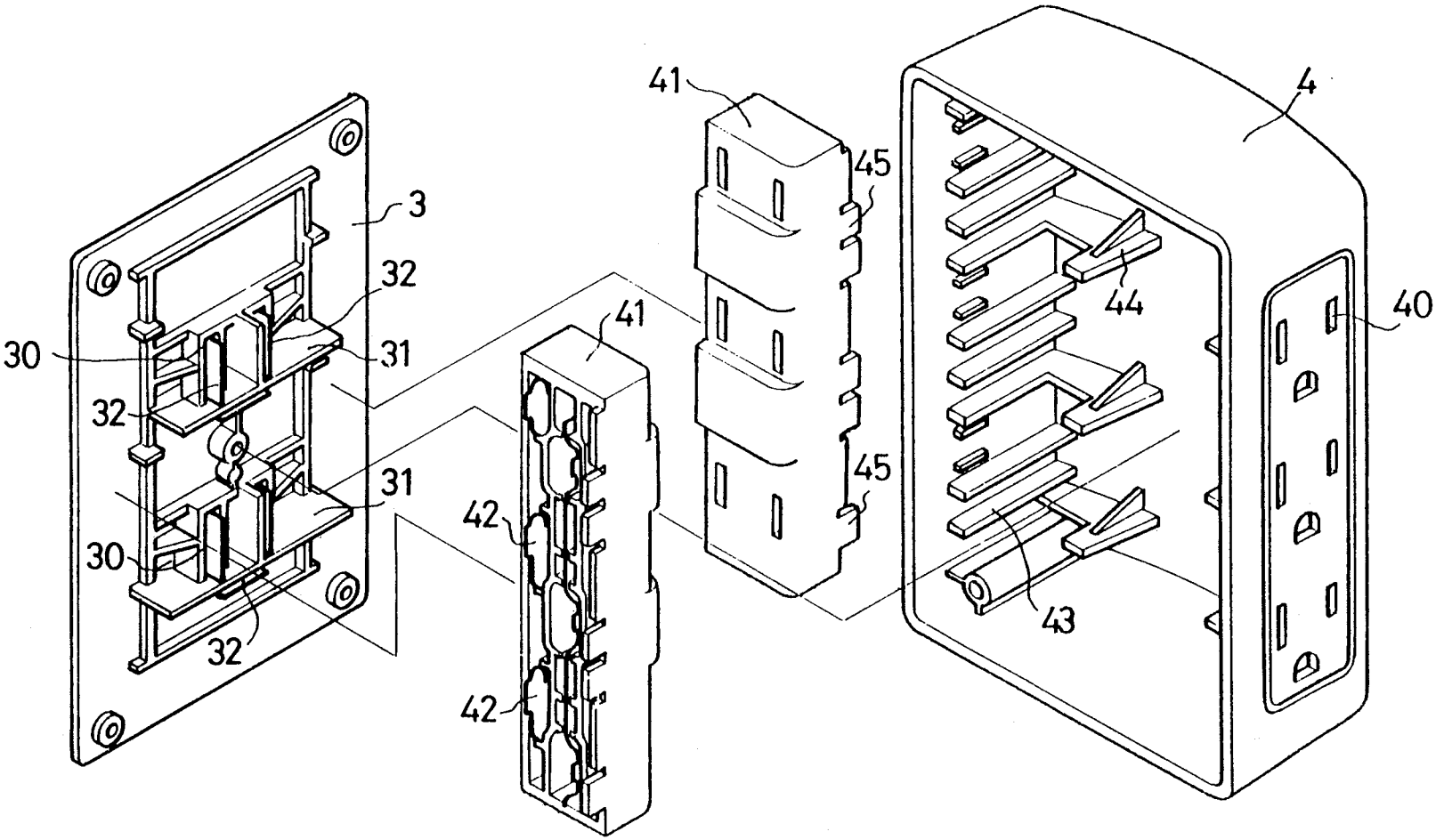
PRIOR ART FIG. 1
FIG. 1 is an exploded perspective view of a prior electrical plug receptacle adapter unit.
Figure 2:
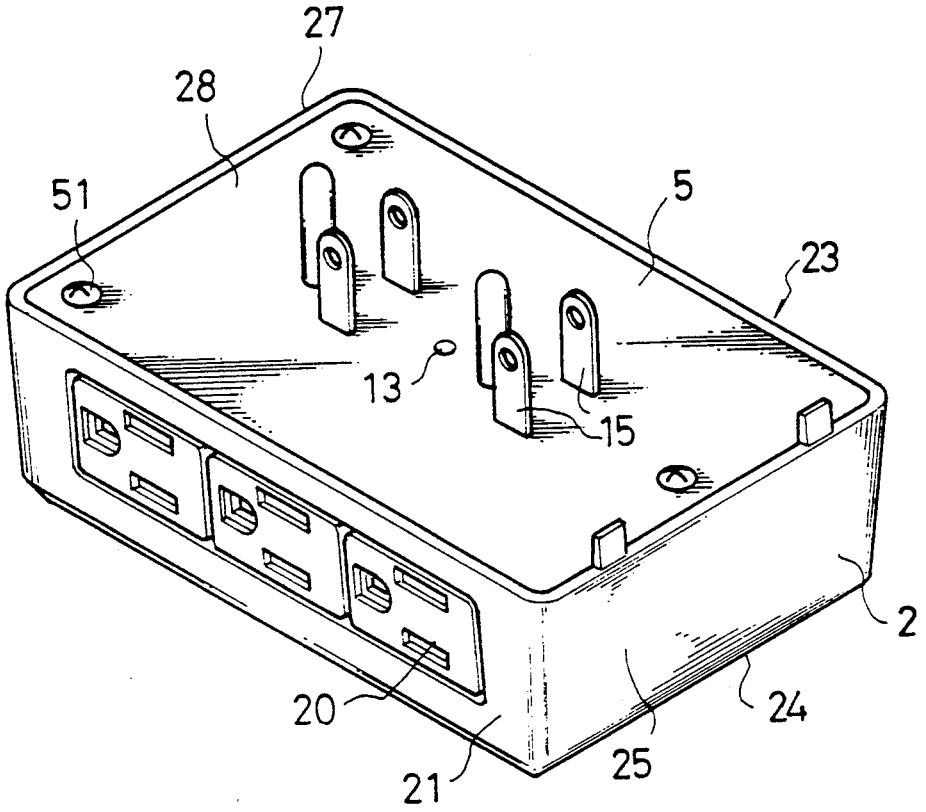
FIG. 2 is a perspective view of a back, a side, and an end of an electrical plug receptacle adapter unit in accordance with the present invention.
Figure 3:
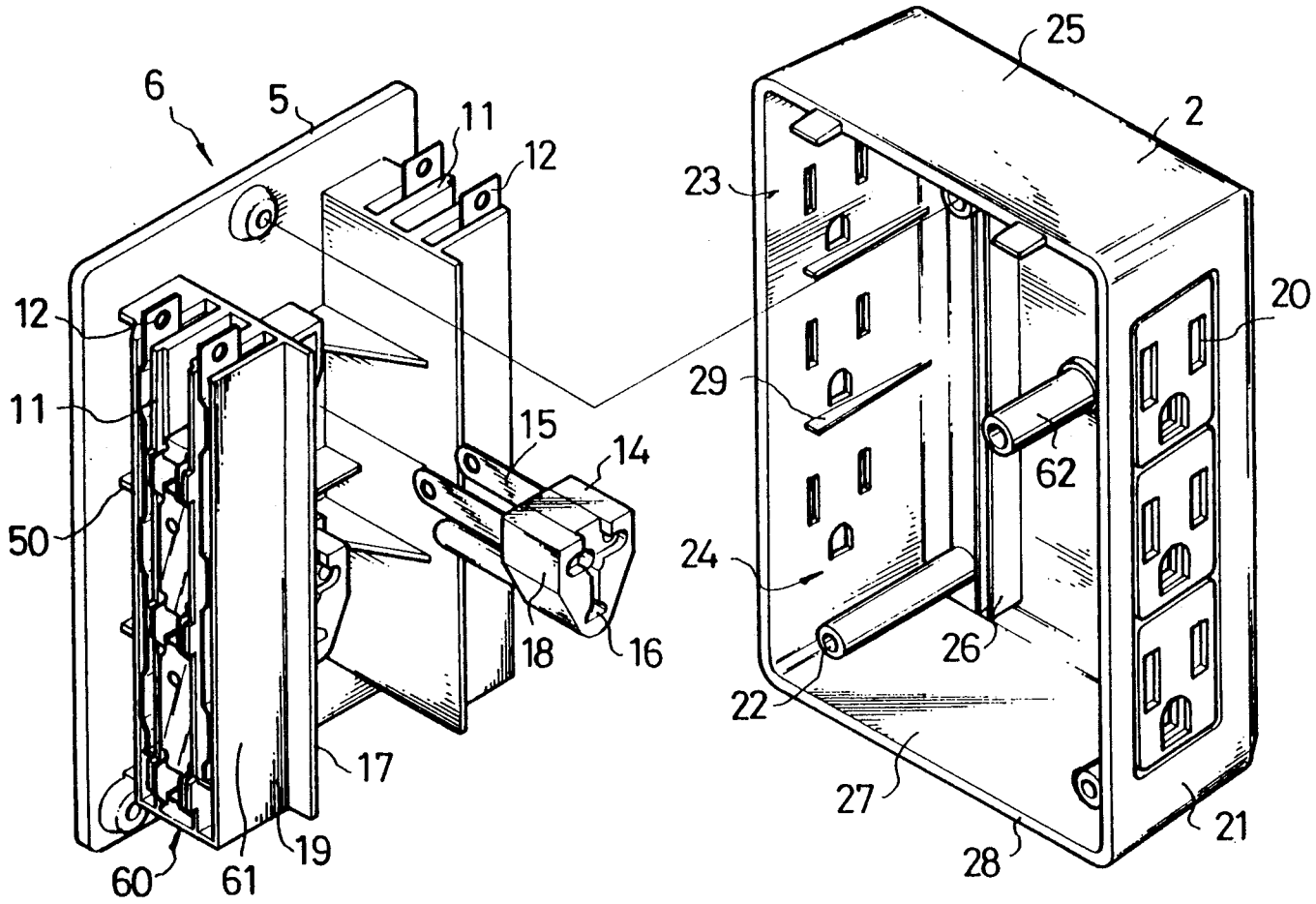
FIG. 3 is an exploded perspective view of the receptacle adapter unit shown in FIG. 1.

As shown in FIGS. 2 and 3, an electrical plug receptacle adapter unit 1 comprises a housing 2 which has a front panel 24, side panels 21 and 23, and end panels 25 and 27. The side panels 21 and 23 together with the end panels 25 and 27 extend rearwardly from the front panel 24 to a perimetric edge 28 which defines a rearward or wall-facing opening. A plurality of apertures 20 for receiving prongs of electrical plugs (not shown) are situated on both side panels 21 and 23.

A coupling means 6 comprises a back plate 5 which is integral with a pair of identical pods 10 as well as a plurality of spacers 50, and two plugs 14. The spacers 50 are situated between the back plate 5 and the pods 10 to distance the two elements. The coupling means 6 is received within the perimetric edge 28 of the housing 2, wherein the back plate 5 is generally parallel to but spaced from the front panel 24. Each pod 10 generally comprises a unitary block 19 of electrically insulative material having a plurality of slots 11 spaced from each other on an outward facing surface 60 thereof. Each unitary block 19 has a strip 17 projecting from the inner side of a forward facing surface 61 of pod 10. A plurality of contact strips 12 are situated in slots 11 of pods 10. Each plug 14 comprises a casing 18 and prongs 15 projecting through the back plate 5 for engagement in a wall receptacle (not shown). The casing 18 includes three penetrating holes 16 for receiving flexible electrical conductors which connect each of the strips 12 to one of the prongs 15, so that each pod 10 is independently connected to only one of the duplex receptacles to which the adapter unit 1 may be inserted. Fasteners 51 secure the back plate 5 to the housing 2.

The housing 2 further includes a plurality of webs 29, which are integral with the side panels 21 or 23, are provided to position pods 10. Two pairs of strips 26, which are integral with the front panel 24, are provided to couple with the strips 17 of the pods 10. The housing 2 additionally has fastener receiving standoffs 22 for receiving the fasteners 51 which secure the back plate 5 to the housing 2. Additionally, a centrally situated sleeve 62 is provided from the front panel 24 of the housing 2 for securing the back plate to the housing 2 through a central aperture 13.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A multiple electrical plug receptacle adapter unit intended for attachment to a wall-mounted electrical plug receptacle comprising:

a housing including a plurality of prong-receiving apertures penetrating said housing, sand a perimetric edge defining a wall-facing opening; and a coupling means including a back plate which is integral with a plurality of pods as well as a plurality of spacers situated between said back plate and said pods, and a plurality of plugs; each plug having prongs projecting through said back plate for engagement in a wall receptacle; said coupling means being received within said perimetric edge of said housing so as to define a space between said plate and the housing, said pods being within said housing adjacent to said apertures, each pod encasing a plurality of contact strips, each strip being aligned with at least two of said apertures;

each pod further comprising flexible means for electrically connecting each contact strip to one prong of said plugs.

2. An adapter unit as claimed in claim 1, wherein each plug includes a casing having three penetrating holes for receiving said flexible means.

3. An adapter unit as claimed in claim 1, wherein said housing includes a front panel generally parallel to said back plate, and side panels extending rearwardly from said front panel to said perimetric edge, said plurality of prong-aperture being confined to said side panels.

4. An adapter unit as claimed in claim 3, wherein said housing includes a plurality of webs for positioning said pods with respect to said plug-receiving apertures.

5. An adapter unit as claimed in claim 1, wherein each pod comprises a unitary block of insulative material having a plurality of slots spaced from each other on an outward facing surface and having a strip projecting from a forward facing surface of said pod.

6. An adapter unit as claimed in claim 5, wherein said housing includes at least two pairs of strips, which are integral with said front panel of said housing, for coupling with said strips of said pods.

* * * * *